US010152004B2

(12) United States Patent
Yoshida et al.

(10) Patent No.: US 10,152,004 B2
(45) Date of Patent: Dec. 11, 2018

(54) CLEANING APPARATUS AND IMAGE FORMATION APPARATUS

(71) Applicant: Konica Minolta, Inc., Tokyo (JP)

(72) Inventors: Eri Yoshida, Toyokawa (JP); Noritoshi Hagimoto, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/359,000

(22) Filed: Nov. 22, 2016

(65) Prior Publication Data

US 2017/0153582 A1 Jun. 1, 2017

(30) Foreign Application Priority Data

Dec. 1, 2015 (JP) ..... 2015-234598

(51) Int. Cl.
*G03G 15/20* (2006.01)
*G03G 21/00* (2006.01)

(52) U.S. Cl.
CPC ..... *G03G 15/2025* (2013.01); *G03G 21/0029* (2013.01); *G03G 21/007* (2013.01); *G03G 21/0011* (2013.01)

(58) Field of Classification Search
CPC ..... G03G 21/0011; G03G 21/0029; G03G 21/007; G03G 15/2025
See application file for complete search history.

(56) References Cited

U.S. PATENT DOCUMENTS

| | | | | |
|---|---|---|---|---|
| 9,989,913 | B2 * | 6/2018 | Nakane | G03G 21/0029 |
| 2011/0129270 | A1 * | 6/2011 | Seo | G03G 21/0011 399/346 |
| 2014/0153990 | A1 * | 6/2014 | Oka | G03G 21/0029 399/351 |
| 2016/0085201 | A1 * | 3/2016 | Isobe | G03G 21/0011 399/111 |

FOREIGN PATENT DOCUMENTS

| | | | |
|---|---|---|---|
| JP | 04172486 | A | 6/1992 |
| JP | 09325659 | A | 12/1997 |
| JP | 2008102322 | A | 5/2008 |
| JP | 2013050527 | A | 3/2013 |
| JP | 2013238892 | A | 11/2013 |

OTHER PUBLICATIONS

Notice of Grounds of Rejection dated Jan. 9, 2018 from corresponding Japanese Patent Application No. 2015-234598.

* cited by examiner

*Primary Examiner* — Joseph S Wong
(74) *Attorney, Agent, or Firm* — Lucas & Mercanti, LLP

(57) ABSTRACT

A cleaning apparatus includes a cleaning member having an abutment member being attached to a tip end portion of a support member. The support member includes a bent portion, an abutment-side support portion, and a fixed-side support portion. The abutment member abuts on a surface of an image carrying member. A point of fixation of the support member fixed to a fixing member is located downstream in a direction of movement relative to a normal at a point of abutment of the abutment member. With an angle of bending $\alpha$ at the bent portion being set to $90° < \alpha < 180°$, the abutment-side support portion is curved in a form of a crest toward downstream in the direction of movement whereas the fixed-side support portion is curved in a form of a crest toward upstream in the direction of movement.

5 Claims, 8 Drawing Sheets

CLEANING APPARATUS AND IMAGE FORMATION APPARATUS

This application is based on Japanese Patent Application No. 2015-234598 filed with the Japan Patent Office on Dec. 1, 2015, the entire content of which is hereby incorporated by reference.

BACKGROUND OF THE INVENTION

Field of the Invention

The present invention relates to a cleaning apparatus which removes a residue such as toner at a surface of an image carrying member from the surface of the image carrying member with the use of a cleaning member and an image formation apparatus including such a cleaning apparatus.

Description of the Related Art

In an image formation apparatus such as a copying machine, a printer, a facsimile machine, and a multi-functional peripheral, after a toner image is transferred from an image carrying member which moves as carrying the toner image on a surface thereof, a residue such as toner which remains at the surface of the image carrying member has conventionally been removed from the surface of the image carrying member with a cleaning apparatus. For example, after a toner image formed on a photoconductor is transferred to an intermediate transfer element such as an intermediate transfer belt or a recording sheet, a residue such as toner which remains at the surface of the photoconductor is removed with a cleaning apparatus, or after the toner image transferred to the intermediate transfer element is transferred to a recording sheet, a residue such as toner which remains at the surface of the intermediate transfer element is removed with the cleaning apparatus.

An apparatus which removes a residue such as toner which remains at a surface of an image carrying member from the surface of the image carrying member by directing a tip end portion of a cleaning member formed from a plate-shaped cleaning blade generally composed of an elastic material such as urethane in a direction opposite to a direction of movement of the surface of the image carrying member so as to have the tip end portion of the cleaning blade abut on the surface of the image carrying member has conventionally been known as such a cleaning apparatus.

When the tip end portion of the cleaning blade abuts on the surface of the image carrying member so as to face the direction opposite to the direction of movement of the surface of the image carrying member, friction resistance between the surface of the image carrying member and the tip end portion of the cleaning blade may become great due to adhesion of a product resulting from discharging during printing or fluctuation in environment. In such a case, the tip end portion of the cleaning blade which abuts on the surface of the image carrying member is pulled toward downstream in the direction of movement due to friction with the surface of the moving image carrying member, and the tip end portion of the cleaning blade gradually deforms. Therefore, the tip end portion of the cleaning blade is flipped over toward downstream in the direction of movement of the surface of the image carrying member and a residue cannot appropriately be removed from the surface of the image carrying member.

In Japanese Laid-Open Patent Publications Nos. 4-172486 and 2008-102322, as shown in FIG. 1, a cleaning member in which one side of a support member 2*b* formed from a leaf spring is fixed to a fixing member 2*a* and an abutment member 2*c* formed from an elastic body is attached to a tip end portion of support member 2*b* is employed as a cleaning member 2 which removes a residue t such as toner which remains at a surface of an image carrying member 1. The tip end portion of abutment member 2*c* attached to the tip end portion of support member 2*b* abuts on the surface of image carrying member 1 at a prescribed abutment pressure with a tip end side of support member 2*b* in cleaning member 2 facing a direction opposite to a direction of movement of the surface of image carrying member 1, so that residue t such as toner which remains at the surface of image carrying member 1 is removed from the surface of image carrying member 1.

When the tip end portion of abutment member 2*c* attached to the tip end portion of support member 2*b* abuts on the surface of image carrying member 1 at a prescribed abutment pressure so as to face the direction opposite to the direction of movement of the surface of image carrying member 1, however, with increase in friction resistance between the surface of image carrying member 1 and the tip end portion of abutment member 2*c* attached to the tip end portion of support member 2*b* due to adhesion of a product resulting from discharging during printing or fluctuation in environment, torque necessary for moving the surface of image carrying member 1 increases. With increase in friction resistance, as in the case of the cleaning blade, the tip end portion of abutment member 2*c* is pulled toward downstream in the direction of movement due to friction with the surface of moving image carrying member 1 and gradually deforms. Then, the tip end portion of abutment member 2*c* is flipped over toward downstream in the direction of movement of the surface of image carrying member 1 and a residue cannot appropriately be removed from the surface of image carrying member 1, or the tip end portion of support member 2*b* to which abutment member 2*c* is attached abuts on the surface of image carrying member 1 and damages the surface of image carrying member 1.

In Japanese Laid-Open Patent Publications Nos. 2013-50527 and 2013-238892, as shown in FIG. 2, cleaning member 2 in which one side of support member 2*b* formed from a leaf spring is fixed to fixing member 2*a* and abutment member 2*c* formed from an elastic body is attached to the tip end portion of support member 2*b* is employed. The tip end portion of abutment member 2*c* attached to the tip end portion of support member 2*b* abuts on the surface of image carrying member 1 at a prescribed abutment pressure so as to face the direction opposite to the direction of movement of the surface of image carrying member 1, to thereby remove residue t such as toner which remains at the surface of image carrying member 1 from the surface of image carrying member 1. Here, a bent portion 2*b*1 obtained by bending support member 2*b* toward upstream in the direction of movement of the surface of image carrying member 1 is provided between one end portion of support member 2*b* fixed to fixing member 2*a* and the tip end portion of support member 2*b* to which abutment member 2*c* is attached, to thereby reduce torque in movement of image carrying member 1 and to prevent the tip end portion of abutment member 2*c* from being flipped over as being pulled toward downstream in the direction of movement due to friction with the surface of moving image carrying member 1.

When bent portion 2*b*1 obtained by bending support member 2*b* toward upstream in the direction of movement of the surface of image carrying member 1 is provided between one end portion of support member 2*b* fixed to fixing member 2*a* and the tip end portion of support member 2*b* to which abutment member 2*c* is attached, with wear of the tip end portion of abutment member 2*c* due to long-term use, it becomes difficult to have the tip end portion of abutment member 2*c* abut on the surface of image carrying member 1 at a sufficient abutment pressure. Thus, residue t cannot sufficiently be removed from the surface of image carrying member 1 and cleaning becomes poor.

SUMMARY OF THE INVENTION

An object of the present invention is to solve the problems as above in a cleaning apparatus which removes a residue at a surface of an image carrying member with a cleaning member in which an abutment member formed from an elastic body is attached to a tip end portion of a support member formed from a leaf spring, with one end side of the support member being fixed to a fixing member and a tip end portion of the abutment member attached to the tip end portion of the support member abutting on a surface of the moving image carrying member.

Namely, an object of the present invention is to appropriately remove a residue at the surface of the image carrying member in a stable manner by appropriately having the tip end portion of the abutment member abut on the surface of the image carrying member in a stable manner even when the tip end portion of the abutment member attached to the tip end portion of the support member is pulled by friction with the surface of the moving image carrying member in the cleaning apparatus as above.

In order to solve the problems as above, a cleaning apparatus in the present invention includes a cleaning member including a support member formed from a leaf spring and an abutment member formed from an elastic body attached to a tip end portion of the support member, the cleaning apparatus removing a residue at a surface of an image carrying member with one end side of the support member being fixed to a fixing member and a tip end portion of the abutment member attached to the tip end portion of the support member abutting on the surface of the moving image carrying member. The support member includes a bent portion, the bent portion being provided between the one end side of the support member fixed to the fixing member and the tip end portion of the support member to which the abutment member is attached and obtained by bending the support member toward downstream in a direction of movement of the surface of the image carrying member, an abutment-side support portion extending from the bent portion to the tip end portion of the support member to which the abutment member is attached, and a fixed-side support portion extending from the bent portion to one end of the support member fixed to the fixing member. The tip end portion of the abutment member abuts on the surface of the image carrying member such that the abutment-side support portion faces a direction opposite to the direction of movement of the surface of the image carrying member, a point of fixation of the support member fixed to the fixing member is located downstream in the direction of movement of the surface of the image carrying member relative to a normal at a point of abutment where the tip end portion of the abutment member abuts on the surface of the image carrying member, and an angle of bending $\alpha$ between the fixed-side support portion and the abutment-side support portion on an upstream side in the direction of movement of the surface of the image carrying member is set to $90° < \alpha < 180°$. While the tip end portion of the abutment member abuts on the surface of the image carrying member to remove a residue at the surface of the image carrying member, the abutment-side support portion is curved in a form of a crest toward downstream in the direction of movement of the surface of the image carrying member, whereas the fixed-side support portion is curved in a form of a crest toward upstream in the direction of movement of the surface of the image carrying member.

In the cleaning apparatus according to the present invention, preferably, a length L1 of the abutment-side support portion and a length L2 of the fixed-side support portion satisfy a condition of L1>L2.

An image formation apparatus according to the present invention includes the cleaning apparatus as above for removing the residue at the surface of the image carrying member from the surface of the image carrying member.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
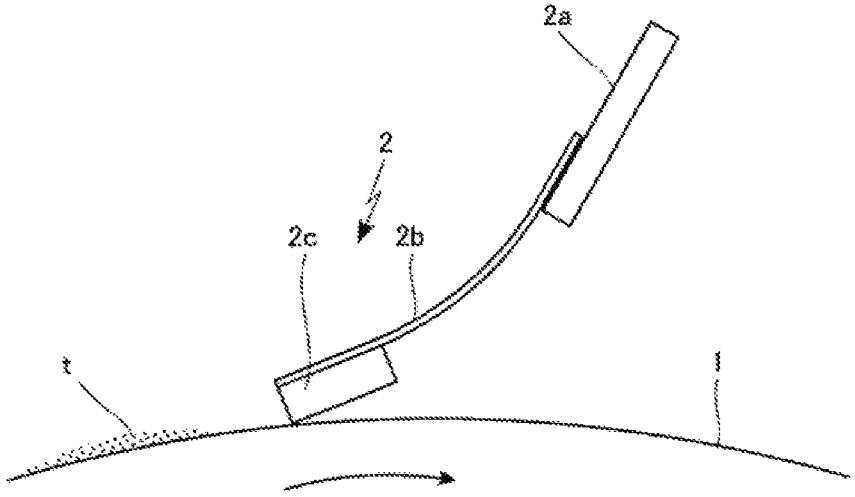
FIG.1 PRIOR ART
FIG. 1 is a schematic illustrative diagram showing a conventional cleaning apparatus including a cleaning member provided with an abutment member made of an elastic body at a tip end portion of a support member made of a leaf spring, the cleaning member removing a residue which remains at a surface of an image carrying member with a tip end portion of the abutment member provided at the tip end portion of the support member abutting on the surface of the image carrying member such that a tip end side of the cleaning member faces a direction opposite to a direction of movement of the surface of the image carrying member.

A cleaning apparatus and an image formation apparatus according to an embodiment of the present invention will now specifically be described with reference to the attached drawings. The cleaning apparatus and the image formation apparatus according to the present invention are not limited to those shown in the embodiment below and can be practiced as being modified as appropriate within the scope not departing from the gist thereof. The same or common elements in the embodiment shown below have the same reference characters allotted and description thereof will not be repeated.

Figure 3:
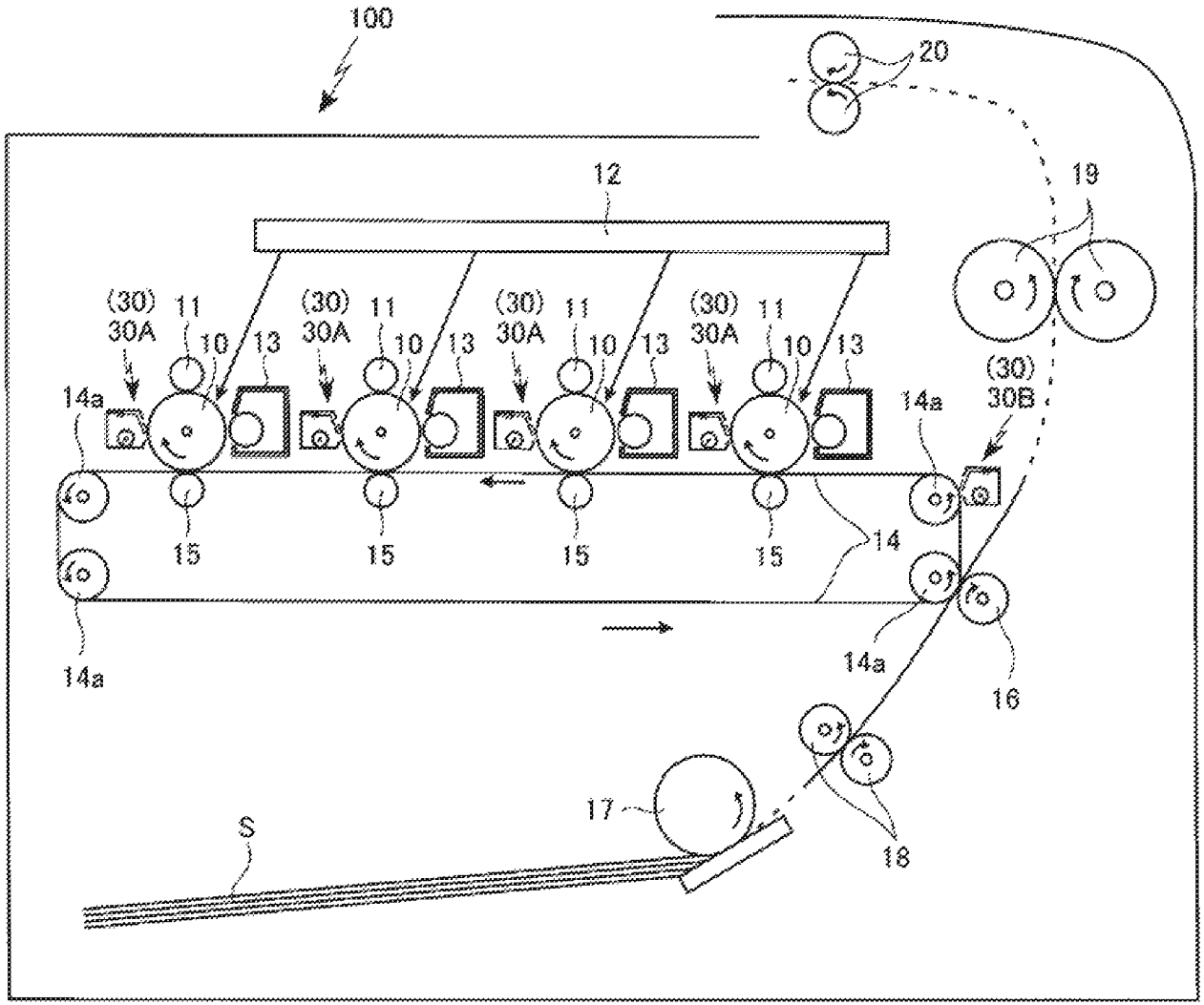
FIG. 3 is a schematic cross-sectional illustrative diagram showing a state of use of an image formation apparatus including the cleaning apparatus according to an embodiment of the present invention.

In an image formation apparatus 100 according to this embodiment, as shown in FIG. 3, four development apparatuses 13 each accommodating a developer are provided in correspondence with four respective photoconductors (image carrying members) 10 on which a toner image is formed, and colors of toner in the developers are different. Toner of black, yellow, magenta, and cyan is used.

In image formation apparatus 100, each photoconductor 10 is rotated, a surface of each photoconductor 10 is charged by a charger 11, each charged photoconductor 10 is exposed in accordance with image formation information by an electrostatic latent image formation apparatus 12, and an electrostatic latent image is formed on a surface of each photoconductor 10.

Development is carried out on each photoconductor 10 on which such an electrostatic latent image is formed, by supplying toner of a prescribed color from corresponding development apparatus 13 to the electrostatic latent image on each photoconductor 10, so that a toner image of each color is formed on the surface of each photoconductor 10.

Then, the toner image of each color formed on each photoconductor 10 as above is primarily transferred sequentially by each primary transfer roller 15 provided to face each photoconductor 10 onto a surface of an intermediate transfer belt (an image carrying member) 14 in a form of an endless belt which is rotationally driven as being looped over a rotary roller 14*a*, so that a full-color toner image is formed on the surface of intermediate transfer belt 14.

A residue t such as toner which remains at the surface of each photoconductor 10 without being transferred to intermediate transfer belt 14 is removed from the surface of each photoconductor 10 by a first cleaning apparatus 30A (30).

The full-color toner image formed on the surface of intermediate transfer belt 14 as above is guided to a position facing a secondary transfer roller 16 by intermediate transfer belt 14.

A recording sheet S accommodated in a lower portion of image formation apparatus 100 is fed by a paper feed roller 17 and sent to a timing roller 18. Timing roller 18 guides recording sheet S to a portion between intermediate transfer belt 14 and secondary transfer roller 16, so that the toner image formed on the surface of intermediate transfer belt 14 is transferred to recording sheet S by secondary transfer roller 16. Residue t such as toner which remains at the surface of intermediate transfer belt 14 without being transferred to recording sheet S is removed from the surface of intermediate transfer belt 14 by a second cleaning apparatus 30B (30).

Recording sheet S to which the toner image has been transferred as above is guided to a fixing apparatus 19, which fixes the transferred toner image onto recording sheet S, and thereafter recording sheet S to which the toner image has been fixed is ejected by a paper ejection roller 20.

First and second cleaning apparatuses 30 (30A, 30B) according to the embodiment to be used in image formation apparatus 100 will now be described.

Figure 4A:
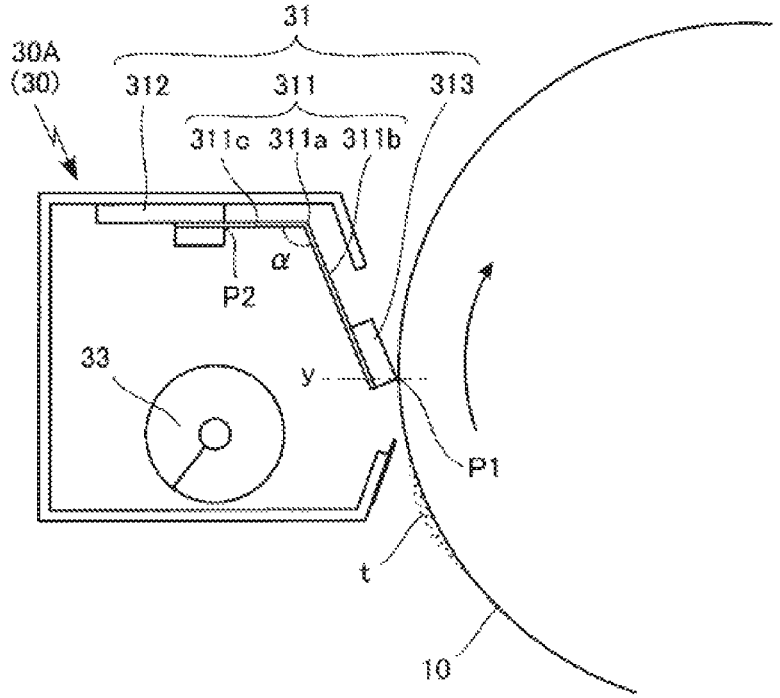
FIGS. 4A and 4B show a state that the residue which remains at the surface of the image carrying member is removed with the cleaning apparatus according to the embodiment of the present invention, with FIG. 4A being a schematic illustrative diagram showing a state that the cleaning apparatus removes the residue which remains at the surface of a photoconductor and FIG. 4B being a schematic illustrative diagram showing a state that the cleaning apparatus removes a residue which remains at a surface of an intermediate transfer belt.
Figure 4B:
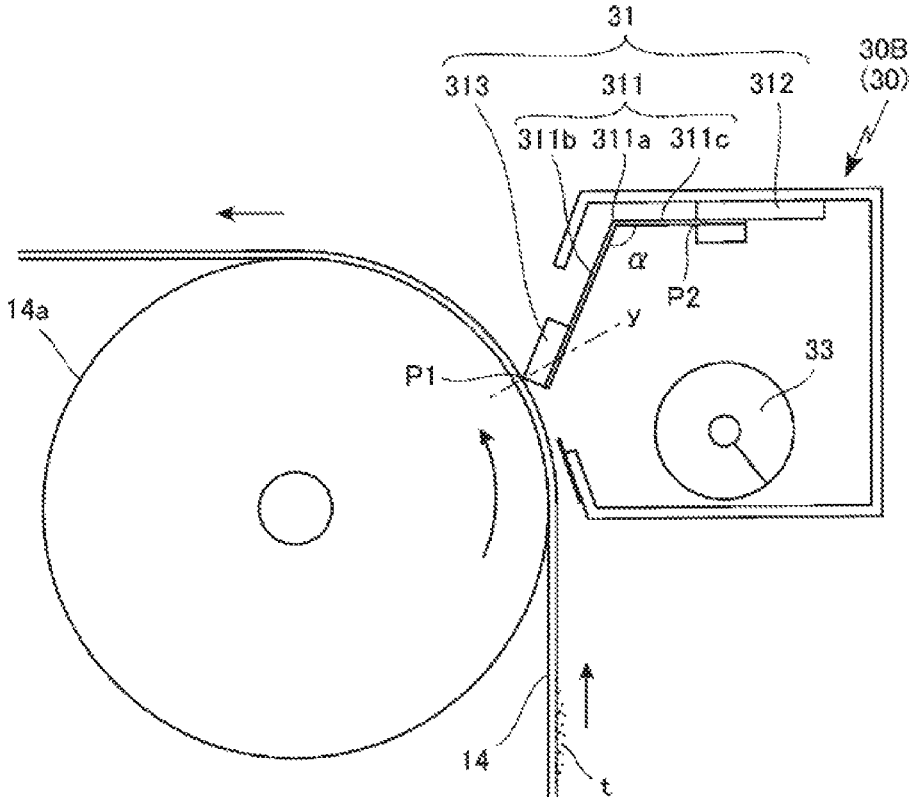

In first and second cleaning apparatuses 30 (30A, 30B), in removing residue t such as toner which remains at the surface of each photoconductor or intermediate transfer belt 14 without being transferred, as shown in FIGS. 4A and 4B, a component constructed such that one side of a support member 311 formed from a leaf spring made of a metal is fixed to a fixing member 312 and an abutment member 313 made of an elastic body is attached to a tip end portion of support member 311 extending from fixing member 312 is employed as a cleaning member 31.

Examples of a material for support member 311 include stainless steel or phosphor bronze which is highly corrosion resistant. In particular, stainless steel high in strength and less in fatigue is preferably employed. A thickness of the material is preferably set approximately to 0.03 to 0.1 mm in order to ensure good followability to photoconductor 10 or intermediate transfer belt 14. Examples of a material for abutment member 313 include urethane rubber used in a conventional cleaning blade. Unlike the conventional cleaning blade, a function to provide a support function or force of abutment is not required, and hence fluoro rubber (FKM), styrene butadiene rubber (SBR), or acrylonitrile rubber (NBR) can also be employed. Preferably, a material excellent in resistance to wear and resistance to ozone is employed.

Figure 5:
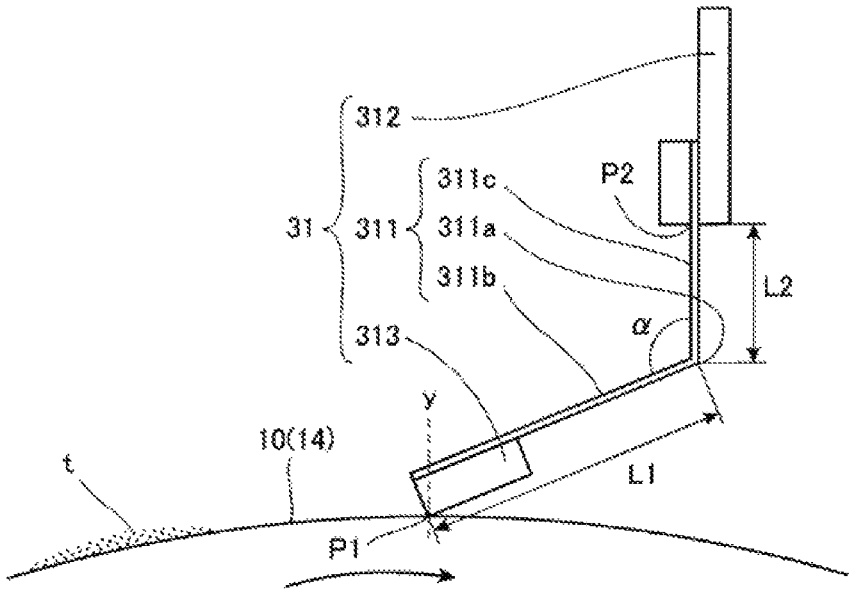
FIG. 5 is a schematic illustrative diagram showing a state that a bent portion bent toward downstream in the direction of movement of the surface of the image carrying member is provided between one end portion of the support member fixed to the fixing member and the tip end portion to which the abutment member is attached in the cleaning apparatus according to the embodiment and the tip end portion of the abutment member attached to the tip end portion of the support member abuts on the surface of the image carrying member so as to face a direction opposite to the direction of movement of the surface of the image carrying member.

In first and second cleaning apparatuses 30 (30A, 30B) in the embodiment included in image formation apparatus 100 shown in FIG. 3, as shown in FIGS. 4A, 4B, and 5, a bent portion 311*a* obtained by bending support member 311 toward downstream in a direction of movement of photoconductor 10 or intermediate transfer belt 14 is provided in support member 311 in cleaning member 31 between one end portion of support member 311 fixed to fixing member 312 and the tip end portion of support member 311 to which abutment member 313 is attached, and the tip end portion of abutment member 313 abuts on the surface of photoconductor 10 or intermediate transfer belt 14 such that an abutment-side support portion 311*b* extending from bent portion 311*a* to the tip end portion of support member 311 to which abutment member 313 is attached faces a direction opposite to the direction of movement of the surface of photoconductor 10 or intermediate transfer belt 14. Cleaning member 31 removes residue t such as toner from the surface of photoconductor 10 or intermediate transfer belt 14 and the residue is recovered in cleaning apparatus 30.

Residue t recovered from the surface of photoconductor 10 or intermediate transfer belt 14 into cleaning apparatus 30 is taken out of cleaning apparatus 30 by a screw 33 provided in cleaning apparatus 30.

A position of a point of fixation P2 of support member 311 fixed to fixing member 312 is located downstream in the direction of movement of photoconductor 10 or intermediate transfer belt 14 relative to a normal y at a point of abutment P1 where the tip end portion of abutment member 313 abuts on the surface of photoconductor 10 or intermediate transfer belt 14, and an angle of bending $\alpha$ on the upstream side in the direction of movement of photoconductor 10 or intermediate transfer belt 14 between a fixed-side support portion 311*c* extending from bent portion 311*a* in support member 311 to the end portion of support member 311 fixed to fixing member 312 and abutment-side support portion 311*b* is set to $90° < \alpha < 180°$.

As set forth above, support member 311 includes bent portion 311*a* obtained by bending support member 311 toward downstream in the direction of movement of the surface of the image carrying member, the bent portion being provided between one end side of support member 311 fixed to fixing member 312 and the tip end portion of support member 311 to which abutment member 313 is attached, abutment-side support portion 311*b* extending from bent portion 311*a* to the tip end portion of support member 311 to which abutment member 313 is attached, and fixed-side support portion 311*c* extending from bent portion 311*a* to one end of support member 311 fixed to fixing member 312.

In cleaning apparatus 30 in this embodiment, a length L1 of abutment-side support portion 311*b* extending from bent portion 311*a* to the tip end portion to which abutment member 313 is attached and a length L2 of fixed-side support portion 311*c* extending from bent portion 311*a* to point of fixation P2 of support member 311 fixed to fixing member 312 satisfy a condition of L1>L2.

A difference between a case in which point of fixation P2 of support member 311 fixed to fixing member 312 is located downstream in the direction of movement of the surface of photoconductor 10 or intermediate transfer belt 14 relative to normal y at point of abutment P1 and a case in which the point of fixation is located upstream in the direction of movement of the surface of photoconductor 10 or intermediate transfer belt 14 will now be described with reference to FIGS. 6A and 6B.

Figure 6A:
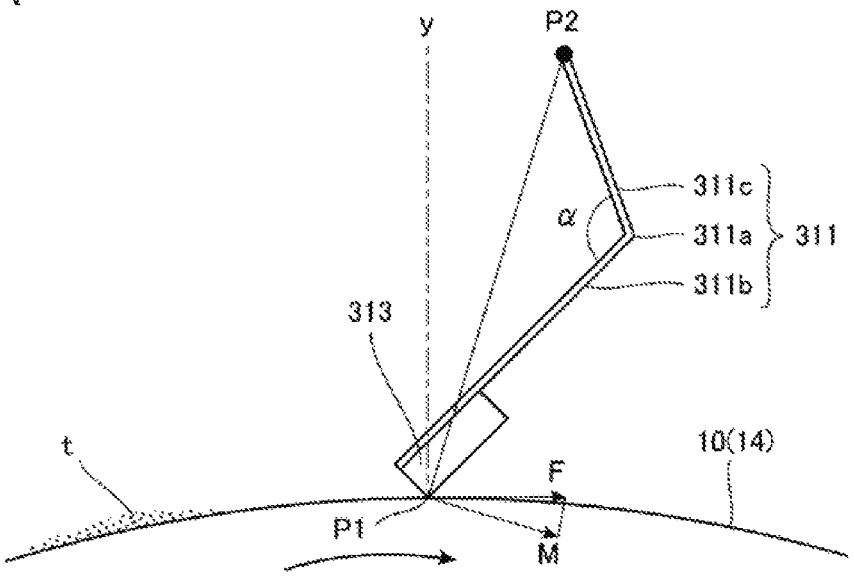
FIGS. 6A and 6B are diagrams showing that a point of fixation of the support member fixed to the fixing member is preferably located downstream in the direction of movement of the surface of the image carrying member relative to a normal at a point of abutment where the tip end portion of the abutment member abuts on the surface of the image carrying member in the cleaning apparatus according to the embodiment, with FIG. 6A being a schematic illustrative diagram showing a moment state that the point of fixation of the support member fixed to the fixing member is located downstream in the direction of movement of the surface of the image carrying member relative to the normal at the point of abutment and FIG. 6B being a schematic illustrative diagram showing a moment state that the point of fixation of the support member fixed to the fixing member is located upstream in the direction of movement of the surface of the image carrying member relative to the normal at the point of abutment.

As shown in FIG. 6A, when point of fixation P2 of support member 311 fixed to fixing member 312 is located downstream in the direction of movement of the surface of photoconductor 10 or intermediate transfer belt 14 relative to normal y at point of abutment P1, with application of friction force F with which the tip end portion of abutment member 313 which abuts on photoconductor 10 or intermediate transfer belt 14 is pulled in the direction of movement of the surface of photoconductor 10 or intermediate transfer belt 14, moment force M in a direction in which the tip end portion of abutment member 313 is pressed against the surface of photoconductor 10 or intermediate transfer belt 14 is applied at point of abutment P1 on photoconductor 10 or intermediate transfer belt 14, with point of fixation P2 serving as the fulcrum.

Figure 6B:
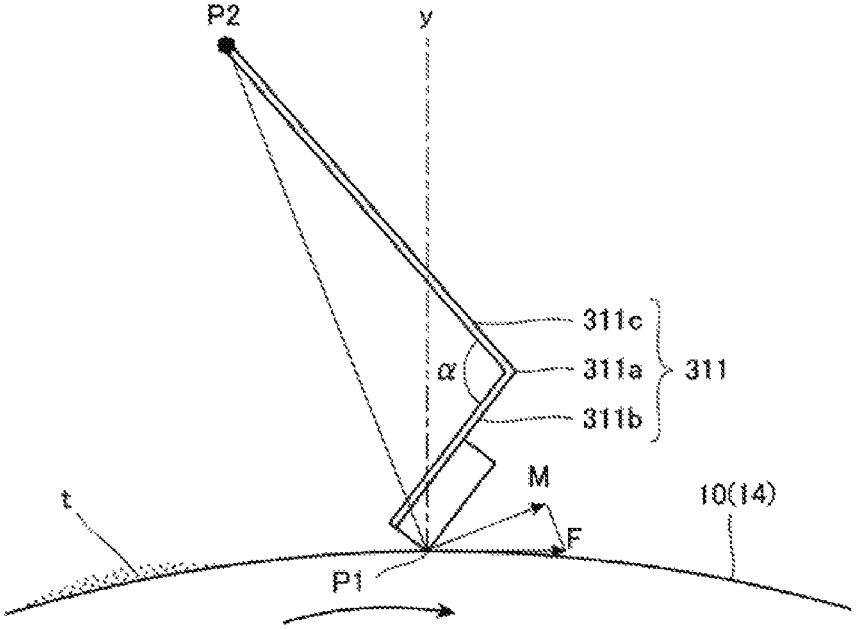

In contrast, as shown in FIG. 6B, when point of fixation P2 of support member 311 fixed to fixing member 312 is located upstream in the direction of movement of the surface of photoconductor 10 or intermediate transfer belt 14 relative to normal y at point of abutment P1, with application of friction force F with which the tip end portion of abutment member 313 which abuts on photoconductor 10 or intermediate transfer belt 14 is pulled in the direction of movement of the surface of photoconductor 10 or intermediate transfer belt 14, moment force M in a direction in which the tip end portion of abutment member 313 is pressed against the surface of photoconductor 10 or intermediate transfer belt 14 is applied at point of abutment P1 on photoconductor 10 or intermediate transfer belt 14, with point of fixation P2 serving as the fulcrum.

Consequently, as shown in FIG. 6A, when point of fixation P2 of support member 311 fixed to fixing member 312 is located downstream in the direction of movement of the surface of photoconductor 10 or intermediate transfer belt 14 relative to normal y at point of abutment P1, the tip end portion of abutment member 313 appropriately abuts on the surface of photoconductor 10 or intermediate transfer belt 14 so that residue t at the surface of photoconductor 10 or intermediate transfer belt 14 is appropriately removed.

As described above, the bent portion bent toward downstream in the direction of movement of the surface of the image carrying member is provided between the one end portion of the support member fixed to the fixing member and the tip end portion to which the abutment member is attached, the tip end portion of the abutment member attached to the tip end portion of the support member abuts on the surface of the image carrying member so as to face the direction opposite to the direction of movement of the surface of the image carrying member, and the point of fixation of the support member fixed to the fixing member is located on the downstream side in the direction of movement of the surface of the image carrying member relative to the normal at the point of abutment where the tip end portion of the abutment member abuts on the surface of the image carrying member. Then, when the tip end portion of the abutment member is pulled toward downstream in the direction of movement of the surface of the image carrying member by friction force between the surface of the moving image carrying member and the tip end portion of the abutment member, moment force in a direction in which the tip end portion of the abutment member is pressed against the image carrying member is applied with the point of fixation of the support member fixed to the fixing member serving as the fulcrum, deformation of the tip end portion of the abutment member as being pulled by the image carrying member is suppressed, and the tip end portion of the abutment member appropriately abuts on the surface of the image carrying member.

Figure 7:
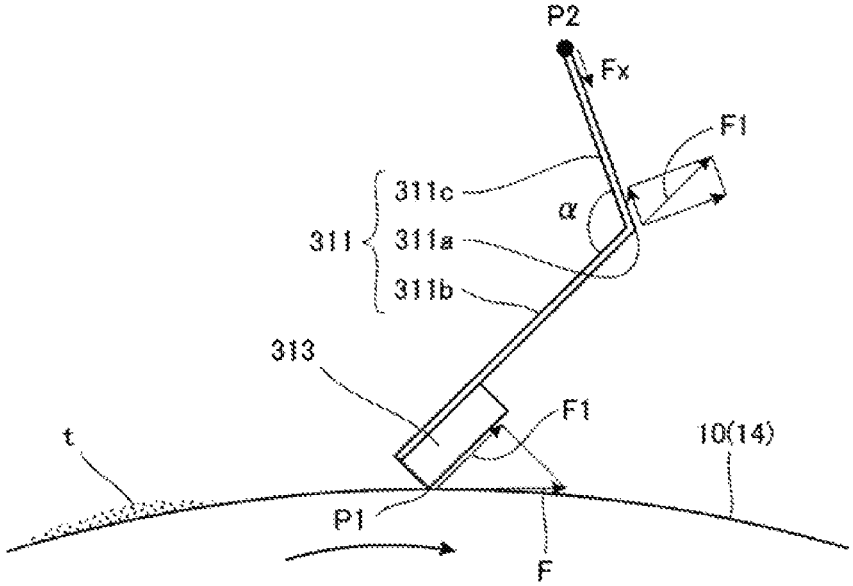
FIG. 7 is a schematic illustrative diagram showing a state that force with which the tip end portion of the abutment member is pressed against the surface of the image carrying member is applied when an angle of bending $\alpha$ on the upstream side in the direction of movement of the surface of the image carrying member at the bent portion is set to $90° < \alpha < 180°$ in the cleaning apparatus according to the embodiment.

As shown in FIG. 7, when the tip end portion of abutment member 313 abuts on the surface of photoconductor 10 or intermediate transfer belt 14 with angle of bending $\alpha$ on the upstream side in the direction of movement of the surface of photoconductor 10 or intermediate transfer belt 14 between fixed-side support portion 311*c* extending from bent portion 311*a* in support member 311 to the end portion of support member 311 fixed to fixing member 312 and abutment-side support portion 311*b* being set to $90° < \alpha < 180°$, with application of friction force F with which the tip end portion of abutment member 313 is pulled in the direction of movement of the surface of photoconductor 10 or intermediate transfer belt 14, component force F1 in a direction along abutment-side support portion 311*b* is applied to bent portion 311*a*. Force resulting from component force F1 along fixed-side support portion 311*c* is applied to point of fixation P2, so that reaction force Fx from point of fixation P2 presses the tip end portion of abutment member 313 against the surface of photoconductor 10 or intermediate transfer belt 14.

Consequently, with angle of bending $\alpha$ on the upstream side in the direction of movement of the surface of photoconductor 10 or intermediate transfer belt 14 between fixed-side support portion 311*c* extending from bent portion 311*a* in support member 311 to the end portion of support member 311 fixed to fixing member 312 and abutment-side support portion 311*b* being set to $90° < \alpha < 180°$, even though the tip end portion of abutment member 313 wears, the tip end portion of abutment member 313 attached to support member 311 is appropriately pressed against the surface of photoconductor 10 or intermediate transfer belt 14 so that residue t at the surface of photoconductor 10 or intermediate transfer belt 14 is appropriately removed in a stable manner.

When angle of bending $\alpha$ on the upstream side in the direction of movement of the surface of the image carrying member between the fixed-side support portion of the support member extending from the bent portion to the end portion of the support member fixed to the fixing member and the abutment-side support portion is set to $90° < \alpha < 180°$ as above, increase in friction force between the surface of the image carrying member and the tip end portion of the abutment member with increase in force of abutment of the tip end portion of the abutment member on the surface of the image carrying member is suppressed as compared with an example in which the tip end portion of the abutment member attached to the support member in a straight form abuts on the surface of the image carrying member, and hence increase in torque for moving the surface of the image carrying member is prevented. When the tip end portion of the abutment member is worn, force in a direction in which the tip end portion of the abutment member is pressed against the surface of the image carrying member is applied to the support member as reaction force against friction force between the tip end portion of the abutment member and the image carrying member so that the tip end portion of the abutment member appropriately abuts on the surface of the image carrying member.

Figure 8A:
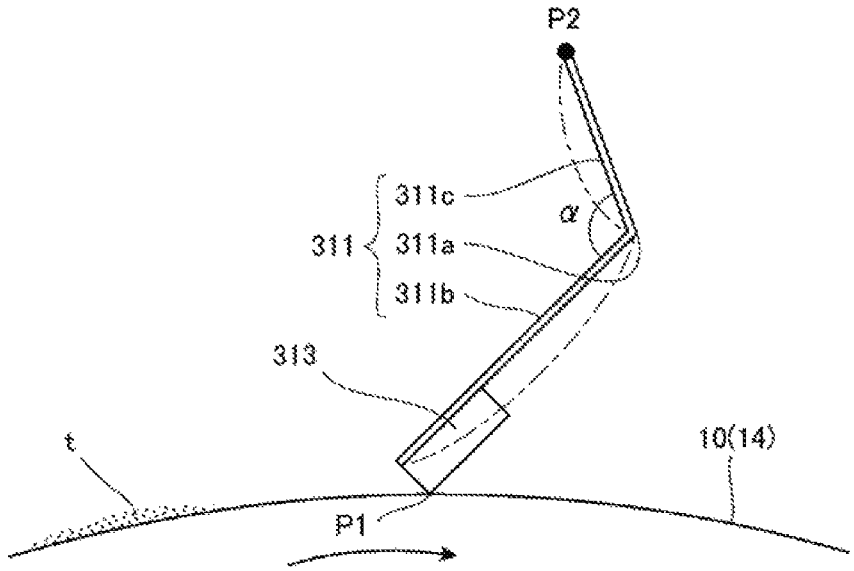
FIGS. 8A and 8B show a state that an abutment-side support portion and a fixed-side support portion in the support member are curved when the residue is removed by having the tip end portion of the abutment member abut on the surface of the image carrying member in the cleaning apparatus according to the embodiment, with FIG. 8A being a schematic illustrative diagram showing a state that the abutment-side support portion is curved in a form of a crest toward downstream in the direction of movement of the surface of the image carrying member whereas the fixed-side support portion is curved in a form of a crest toward upstream in the direction of movement of the surface of the image carrying member and FIG. 8B being a schematic illustrative diagram showing a state that both of the abutment-side support portion and the fixed-side support portion are curved in a form of a crest toward downstream in the direction of the movement of the surface of the image carrying member when angle of bending $\alpha$ is close to 180°.

When angle of bending $\alpha$ at bent portion 311*a* between fixed-side support portion 311*c* extending from bent portion 311*a* in support member 311 to the end portion of support member 311 fixed to fixing member 312 and abutment-side support portion 311*b* is set to $90° < \alpha < 180°$ and the tip end portion of abutment member 313 abuts on the surface of photoconductor 10 or intermediate transfer belt 14 so as to remove residue t, in a normal state, as shown in FIG. 8A, abutment-side support portion 311*b* is curved in a form of a crest toward downstream in the direction of movement of the surface of photoconductor 10 or intermediate transfer belt 14, whereas fixed-side support portion 311*c* is curved in a form of a crest toward upstream in the direction of movement of the surface of photoconductor 10 or intermediate transfer belt 14. With abutment-side support portion 311*b* and fixed-side support portion 311*c* being thus curved in opposite directions, the tip end portion of abutment member 313 can abut on the surface of photoconductor 10 or intermediate transfer belt 14 at an appropriate abutment pressure in a stable manner.

When force of abutment of the tip end portion of the abutment member on the surface of the image carrying member is increased as above, increase in torque for moving the surface of the image carrying member due to increase in friction force between the surface of the image carrying member and the tip end portion of the abutment member is appropriately suppressed. Force in the direction in which the tip end portion of the abutment member is pressed against the surface of the image carrying member is applied appropriately when the tip end portion of the abutment member is worn.

Figure 8B:
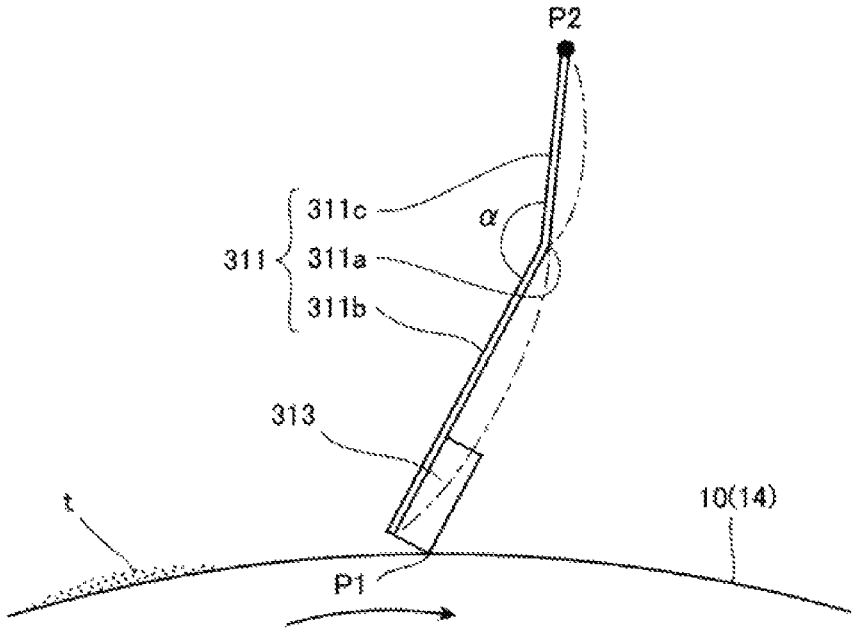

When angle of bending $\alpha$ is close to 180°, however, force which deforms bent portion 311*a* toward downstream in the direction of movement of the surface of photoconductor 10 or intermediate transfer belt 14 is applied. As shown in FIG. 8B, abutment-side support portion 311*b* and fixed-side support portion 311*c* are curved in a form of a crest toward downstream in the direction of movement of the surface of photoconductor 10 or intermediate transfer belt 14 and the tip end portion of abutment member 313 may not be able to abut on the surface of photoconductor 10 or intermediate transfer belt 14 at an appropriate abutment pressure in a stable manner.

Figure 9A:
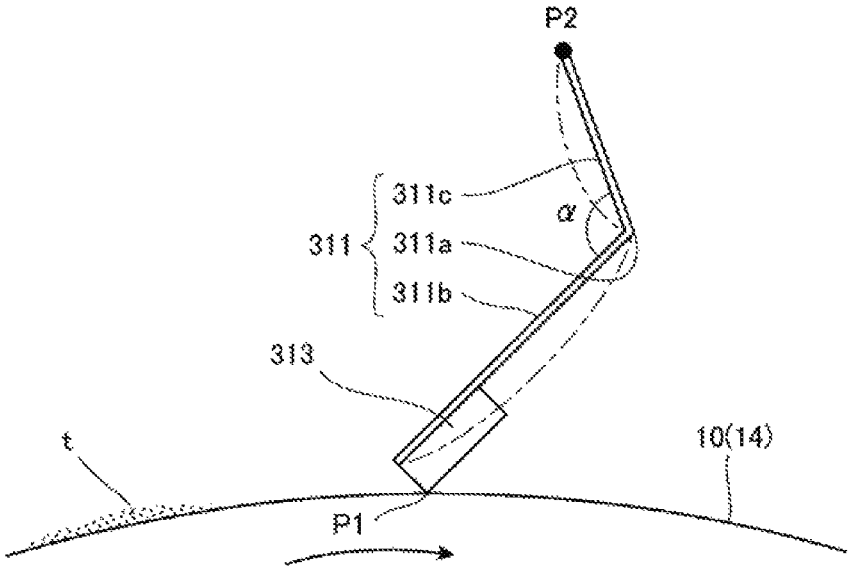
FIGS. 9A and 9B are diagrams showing comparison between a case of L1>L2 and a case of L1<L2, where L1 represents a length of the abutment-side support portion extending from the bent portion to the tip end portion of the support member to which the abutment member is attached and L2 represents a length of the fixed-side support portion extending from the bent portion to the point of fixation where the end portion of the support member is fixed to the fixing member in the cleaning apparatus according to the embodiment, with FIG. 9A being a schematic illustrative diagram showing a state that the tip end portion of the abutment member deforms as being pulled toward downstream in the direction of movement of the surface of the image carrying member when a condition of L1>L2 is satisfied and FIG. 9B being a schematic illustrative diagram showing a state that the tip end portion of the abutment member deforms as being pulled toward downstream in the direction of movement of the surface of the image carrying member when a condition of L1<L2 is satisfied.

As shown in FIG. 9A, when length L1 of abutment-side support portion 311*b* extending from bent portion 311*a* to the tip end portion of support member 311 to which abutment member 313 is attached is longer than length L2 of fixed-side support portion 311*c* extending from bent portion 311*a* to point of fixation P2 where the end portion of support member 311 is fixed to fixing member 312 (L1>L2), even with application of friction force F which pulls in the direction of movement of the surface of photoconductor 10 or intermediate transfer belt 14 to the tip end portion of abutment member 313, a distance over which the tip end portion of abutment member 313 is moved as being pulled in the direction of movement of the surface of photoconductor 10 or intermediate transfer belt 14 is short because of shorter length L2 of fixed-side support portion 311*c*, variation in state of abutment member 313 which abuts on the surface of photoconductor 10 or intermediate transfer belt 14 is less, and the tip end portion of abutment member 313 can abut on the surface of photoconductor 10 or intermediate transfer belt 14 in a stable manner.

A state of abutment of the tip end portion of the abutment member on the surface of the image carrying member is prevented from varying when the tip end portion of the abutment member is pulled by force of friction with the surface of the moving image carrying member.

Figure 9B:
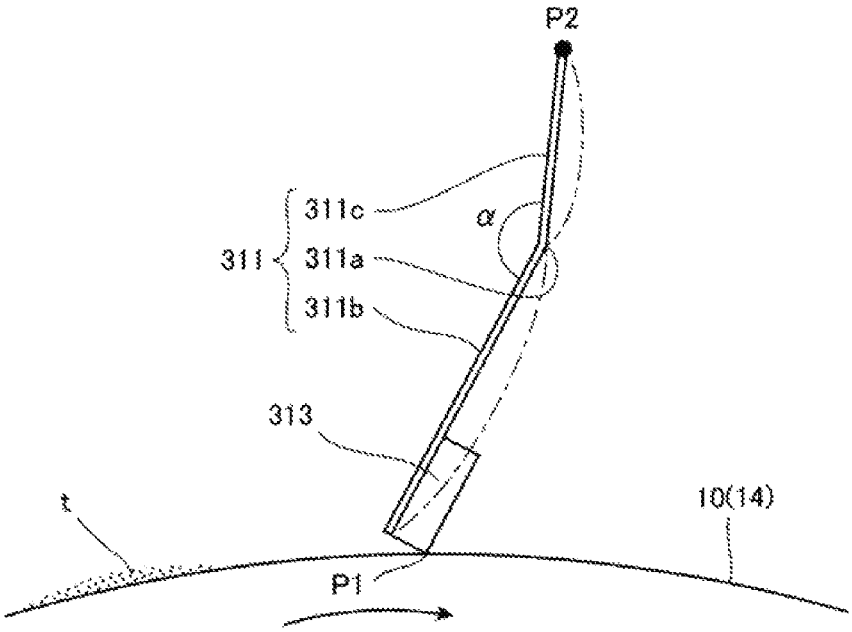

As shown in FIG. 9B, when length L1 of abutment-side support portion 311*b* extending from bent portion 311*a* to the tip end portion of support member 311 to which abutment member 313 is attached is shorter than length L2 of fixed-side support portion 311*c* extending from bent portion 311*a* to point of fixation P2 where the end portion of support member 311 is fixed to fixing member 312 (L1<L2), with application of friction force F which pulls in the direction of movement of the surface of photoconductor 10 or intermediate transfer belt 14 to the tip end portion of abutment member 313, a distance over which the tip end portion of abutment member 313 is moved as being pulled in the direction of movement of the surface of photoconductor 10 or intermediate transfer belt 14 is long because of longer length L2 of fixed-side support portion 311*c* and a state of abutment member 313 which abuts on the surface of photoconductor 10 or intermediate transfer belt 14 significantly varies. Thus, the tip end portion of abutment member 313 may not be able to abut on the surface of photoconductor 10 or intermediate transfer belt 14 in a stable manner.

Therefore, preferably, length L1 of abutment-side support portion 311*b* extending from bent portion 311*a* to the tip end portion of support member 311 to which abutment member 313 is attached is longer than length L2 of fixed-side support portion 311*c* extending from bent portion 311*a* to point of fixation P2 where the end portion of support member 311 is fixed to fixing member 312 (L1>L2).

A cleaning apparatus which removes a residue which remains at a surface of a photoconductor in a photoconductor drum unit in a commercially available multi-functional peripheral (bizhub C654e manufactured by Konica Minolta Inc.) was modified, and experiments were conducted with a cleaning member included in the cleaning apparatus being changed.

In the experiments, a cleaning member in which an abutment member composed of urethane rubber was attached to a tip end portion of a support member made of SUS304 was employed as the cleaning member, and the tip end portion of the abutment member abutted on the surface of the photoconductor toward upstream in the direction of movement of the photoconductor.

In Examples 1 to 3, as shown in the embodiment, a cleaning member provided with a bent portion obtained by bending the support member toward downstream in the direction of movement of the surface of the image carrying member between one end portion of the support member fixed to the fixing member and the tip end portion of the support member to which the abutment member was attached was employed. As shown in Table 1 below, cleaning members in which angle of bending α on the upstream side in the direction of movement of the photoconductor at the bent portion was set to 100° and length L1 of the abutment-side support portion extending from the bent portion to the tip end portion of the support member to which the abutment member was attached and length L2 of the fixed-side support portion extending form the bent portion to the point of fixation where the end portion of the support member was fixed to the fixing member were varied were employed.

In Comparative Example 1, as shown in Table 1 below, a cleaning member without a bent portion in the support member like the cleaning member shown in FIG. 1 was employed. In this case, a length L (L1+L2) of the support member extending from the tip end portion of the support member to which the abutment member was attached to the point of fixation where the end portion of the support member was fixed to the fixing member was set to 14 mm.

Figure 2:
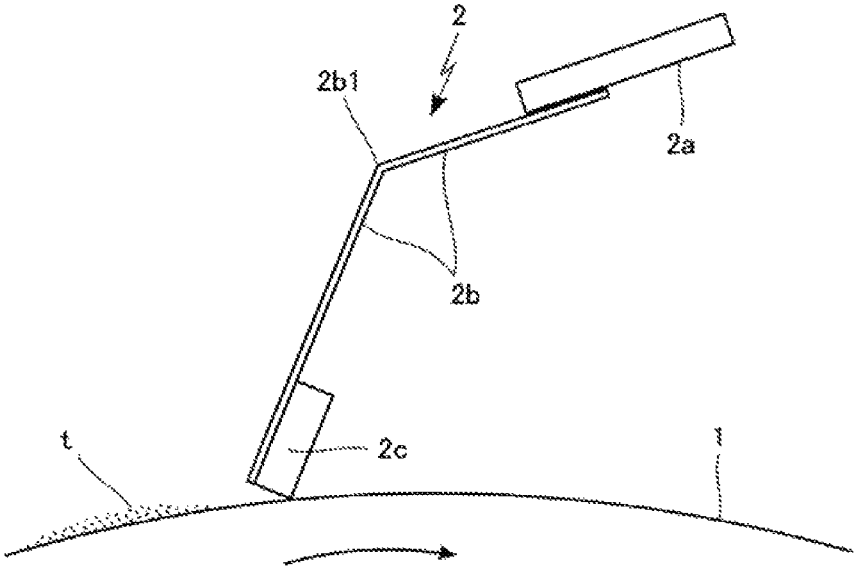
FIG.2 PRIOR ART
FIG. 2 is a schematic illustrative diagram showing a conventional cleaning apparatus including a cleaning member provided with an abutment member made of an elastic body at a tip end portion of a support member made of a leaf spring, in which a bent portion obtained by bending the support member toward upstream in a direction of movement of a surface of an image carrying member is provided between one end portion of the support member fixed to a fixing member and the tip end portion of the support member to which the abutment member is attached, in removing a residue which remains at the surface of the image carrying member with the tip end portion of the abutment member provided at the tip end portion of the support member abutting on the surface of the image carrying member such that a tip end side of the cleaning member faces a direction opposite to the direction of movement of the surface of the image carrying member.

In Comparative Example 2, a cleaning member provided with a bent portion obtained by bending the support member toward upstream in the direction of movement of the surface of the image carrying member between one end portion of the support member fixed to the fixing member and the tip end portion of the support member to which the abutment member was attached like the cleaning member shown in FIG. 2 was employed. As shown in Table 1 below, angle of bending α on the upstream side in the direction of movement of the photoconductor at the bent portion was set to 300°, length L1 of the abutment-side support portion extending from the bent portion to the tip end portion of the support member to which the abutment member was attached was set to 12 mm, and length L2 of the fixed-side support portion extending from the bent portion to the point of fixation where the end portion of the support member was fixed to the fixing member was set to 8 mm.

Torque of the photoconductor and cleaning capability of the cleaning member were evaluated by using the cleaning apparatuses in Examples 1 to 3 and Comparative Examples 1 and 2, and Table 1 below shows results thereof together.

In evaluating torque of the photoconductor, a torque converter was attached between a drive shaft which drives a rotation shaft of the photoconductor and a motor, a torque value converted to a voltage was read, and initial torque of the photoconductor before printing and torque of the photoconductor after printing after a toner image of which coverage was 25% was printed on ten thousand sheets of paper of a horizontal A4 size were measured. Increase in torque of the photoconductor after printing as compared with the initial torque being not greater than 0.1 N·m was evaluated as OK and increase in torque of the photoconductor by an amount exceeding 0.1 N·m was evaluated as NG as shown in Table 1.

In evaluating cleaning capability of the cleaning member, a print durability test in which a toner image of which coverage was 25% was formed on paper of a horizontal A4 size was conducted under a low-temperature and low-humidity environmental condition at a temperature of 10° C. and a humidity of 15% and a high-temperature and high-humidity environmental condition at a temperature of 30° C. and a humidity of 85%. Each cleaning apparatus carried out cleaning without transferring a solid toner image from the photoconductor to paper in printing on twenty thousand sheets, twenty five thousand sheets, fifty thousand sheets, seventy five thousand sheets, and one hundred thousand sheets, and a state of remaining toner at the surface of the photoconductor after cleaning was visually checked. Absence of poor cleaning was evaluated as OK and presence of poor cleaning was evaluated as NG as shown in Table 1 below.

TABLE 1

| | Support Member | | | Items to be Evaluated | | | | | | | | | | | |
|---|---|---|---|---|---|---|---|---|---|---|---|---|---|---|---|
| | | | | | Cleaning Capability (Ten Thousand Sheets) | | | | | | | | | | |
| | Angle of Bending α | Length L1 | Length L2 | | High-Temperature and High Humidity Environment | | | | | Low-Temperature and Low Humidity Environment | | | | | |
| | (°) | (mm) | (mm) | Torque | 2 | 2.5 | 5 | 7.5 | 10 | 2 | 2.5 | 5 | 7.5 | 10 |
| Example 1 | 100 | 12 | 8 | OK | OK | OK | OK | OK | OK | OK | OK | OK | OK | OK |
| Example 2 | 100 | 8 | 12 | OK | OK | OK | OK | OK | NG | OK | OK | OK | NG | NG |
| Example 3 | 100 | 8 | 8 | OK | OK | OK | OK | OK | OK | OK | OK | OK | OK | NG |
| Comparative Example 1 | — | 14 | | OK | OK | OK | OK | OK | OK | OK | OK | OK | OK | OK |
| Comparative Example 2 | 300 | 12 | 8 | OK | OK | OK | NG | NG | NG | NG | NG | NG | NG | NG |

As is clear from the results, when the cleaning members shown in Examples 1 to 3 of the present invention were employed, increase in torque of the photoconductor in printing was suppressed as compared with that in Comparative Example 1 in which the cleaning member without the bent portion in the support member as shown in FIG. 1 was employed, and cleaning capability after printing was improved as compared with Comparative Example 2 including the cleaning member provided with the bent portion obtained by bending the support member toward upstream in the direction of movement of the surface of the image carrying member between one end portion of the support member fixed to the fixing member and the tip end portion of the support member to which the abutment member was attached as shown in FIG. 2.

When the cleaning apparatuses including the cleaning members in Examples 1 to 3 were compared with one another, the cleaning apparatus including the cleaning member in Example 1 in which length L1 of the abutment-side support portion extending from the bent portion to the tip end portion of the support member to which the abutment member was attached was longer than length L2 of the fixed-side support portion extending from the bent portion to the point of fixation where the end portion of the support member was fixed to the fixing member (L1>L2) achieved further improvement in cleaning capability after printing as compared with the cleaning apparatus including the cleaning member in Example 2 in which length L1 of the abutment-side support portion was shorter than length L2 of the fixed-side support portion (L1<L2) or the cleaning apparatus including the cleaning member in which length L1 of the abutment-side support portion and length L2 of the fixed-side support portion were equal to each other (L1=L2).

Though the embodiment of the present invention has been described, it should be understood that the embodiment disclosed herein is illustrative and non-restrictive in every respect. The scope of the present invention is defined by the terms of the claims and is intended to include any modifications within the scope and meaning equivalent to the terms of the claims.

What is claimed is:

1. A cleaning apparatus comprising a cleaning member including a support member formed from a leaf spring and an abutment member formed from an elastic body attached to a tip end portion of the support member, the cleaning apparatus removing a residue at a surface of an image carrying member with one end side of the support member being fixed to a fixing member and a tip end portion of the abutment member attached to the tip end portion of the support member abutting on the surface of the moving image carrying member, the support member having an upstream side surface facing upstream in the direction of movement of the surface of the image carrying member in relation to the position of the support member and a downstream side surface facing downstream in the direction of movement of the surface of the image carrying member in relation to the position of the support member, each of the upstream side surface and the downstream side surface extending from the fixing member to the tip end portion, the support member including a bent portion, the bent portion being provided between the one end side of the support member fixed to the fixing member and the tip end portion of the support member to which the abutment member is attached and obtained by bending the support member toward downstream in a direction of movement of the surface of the image carrying member, an abutment-side support portion extending from the bent portion to the tip end portion of the support member to which the abutment member is attached, and a fixed-side support portion extending from the bent portion to one end of the support member fixed to the fixing member, the tip end portion of the abutment member abutting on the surface of the image carrying member such that the abutment-side support portion faces a direction opposite to the direction of movement of the surface of the image carrying member, a point of fixation of the support member fixed to the fixing member being located downstream in the direction of movement of the surface of the image carrying member relative to a normal at a point of abutment where the tip end portion of the abutment member abuts on the surface of the image carrying member, an angle of bending α between the fixed-side support portion and the abutment-side support portion on an upstream side surface of the support member in the direction of movement of the surface of the image carrying member being set to $90° < \alpha < 180°$, and while the tip end portion of the abutment member abuts on the surface of the image carrying member to remove a residue at the surface of the image carrying member, the abutment-side support portion being curved in a form of a crest toward downstream in the direction of movement of the surface of the image carrying member, whereas the fixed-side support portion being curved in a form of a crest toward upstream in the direction of movement of the surface of the image carrying member.

2. The cleaning apparatus according to claim 1, wherein a length L1 of the abutment-side support portion and a length L2 of the fixed-side support portion satisfy a condition of L1>L2.

3. An image formation apparatus comprising the cleaning apparatus according to claim 1, the cleaning apparatus removing the residue at the surface of the image carrying member.

4. The cleaning apparatus according to claim 1, wherein a thickness of the material for the support member is 0.03 to 0.1 mm.

5. The cleaning apparatus according to claim 1, wherein the abutment member is made of a material including fluoro rubber, styrene butadiene rubber, or acrylonitrile rubber.

* * * * *